United States Patent [19]

Kogure et al.

[11] 4,219,696

[45] Aug. 26, 1980

[54] SOUND IMAGE LOCALIZATION CONTROL SYSTEM

[75] Inventors: Takuyo Kogure, Neyagawa; Masatoshi Shimbo, Nishinomiya; Toshiyuki Goto, Katano, all of Japan

[73] Assignee: Matsushita Electric Industrial Co., Ltd., Osaka, Japan

[21] Appl. No.: 879,503

[22] Filed: Feb. 21, 1978

[30] Foreign Application Priority Data

Feb. 18, 1977 [JP] Japan ..... 52-19115[U]

[51] Int. Cl.[2] ..... H04R 5/04

[52] U.S. Cl. ..... 179/1 G; 179/1 GP; 179/1 GQ

[58] Field of Search ..... 179/1 G, 1 GQ, 1 GP, 179/100.1 TD, 100.4 ST

[56] References Cited

U.S. PATENT DOCUMENTS

| | | | |
|---|---|---|---|
| 3,236,949 | 2/1966 | Atal et al. | 179/1 G |
| 3,238,304 | 3/1966 | Yaita et al. | 179/1 G |
| 3,725,586 | 4/1973 | Iida | 179/1 GP |
| 4,118,599 | 10/1978 | Iwahara et al. | 179/1 G |

*Primary Examiner*—Douglas W. Olms

*Attorney, Agent, or Firm*—Stevens, Davis, Miller & Mosher

[57] ABSTRACT

A sound reproducing system for reproducing sounds from two loudspeakers located in front of a listener comprises a difference creating network for causing a ratio of sound pressures applied to left and right ears of the listener and causing a time difference between sound waves thereat by a sound radiated from a sound source located at any point around the listener, and a front and back recognizing network provided in common with both ears for cancelling information which causes the listener to feel that said loudspeakers are located in front of the listener and enabling the listener to localize a sound image at any point, whereby the listener can localize the sound image at any point around the listener while he is listening the sounds radiated from the two loudspeakers located in front of him.

6 Claims, 15 Drawing Figures

SOUND IMAGE LOCALIZATION CONTROL SYSTEM

The present invention relates to a sound reproducing system with two loudspeakers and it is an object of the present invention to provide a sound reproducing system which enables a listener to localize a sound image in any direction around him while he is listening to sounds radiated from two loudspeakers located in front of him and on the left and right sides of him.

In a two-speaker stereophonic sound reproducing system, a range of the sound image that the listener feels is usually distributed and localized between the two loudspeakers.

The change of consumer's preference due to the development of sound reproducing systems has established a goal of enlarging the range of the sound image localization, which was heretofore limited to a range between the two loudspeakers, to attain the sound reproduction of a large scale which the original sound field possesses. Thus, a four-channel sound reproducing system has been proposed. In this system, sounds are reproduced by four loudspeakers located in four directions in a listening room to enlarge a sound space. However, the four-channel sound reproducing system requires two sets of stereophonic amplifiers and four loudspeakers and hence it has not attained wide popularity because of the low economy of the reproducing apparatus and the large space required.

Accordingly, an object of the invention is to enlarge the range of sound image localization of a sound reproducing system.

The present invention is now explained in detail with reference to the accompanying drawings, in which.

Figure 1:
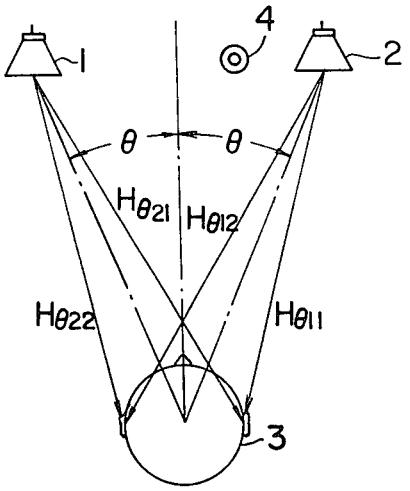
FIG. 1 PRIOR ART
FIG. 1 shows a schematic diagram of a piror art two-speaker stereophonic sound reproducing system.

Referring now to FIG. 1, there is shown schematically a prior art two-speaker stereophonic sound reproducing system, in which stereophonic signals are applied to left and right loudspeakers 1 and 2 to reproduce sounds. In this prior art system, the range of a sound image 4 which a listener 3 perceives is located between the loudspeakers 1 and 2.

Figure 2:
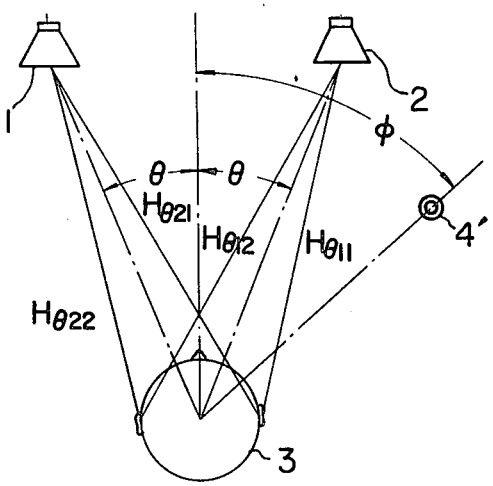
FIG. 2 shows a schematic diagram of a two-speaker stereophonic sound reproducing system of the present invention.

Referring to FIG. 2, the present invention provides a sound reproducing system which enables the listener 3 to perceive a sound image 4' at any point around him while he is listening to sounds radiated from the loudspeakers located in front of him on his left and right sides. The enlargement of the range of the sound image is attained by the addition of a network in a sound processing stage preceding the loudspeakers 1 and 2.

In general, the listener can determine the direction of the sound source both for a relatively distant sound source and for a near sound source. This is because the listener can determine the direction of the sound source by a ratio of sound waves received by his left and right ears and a difference between arrival times of the sound waves at the left and right ears.

Figure 3:
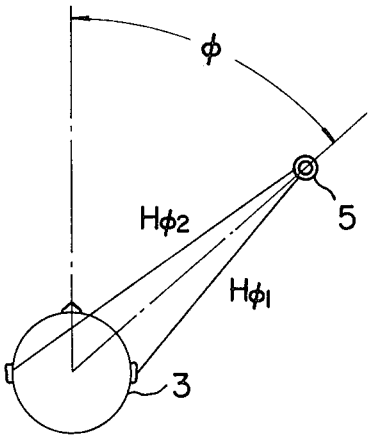
FIG. 3 shows a schematic diagram illustrating a listening condition in a real sound field.
Figure 4:
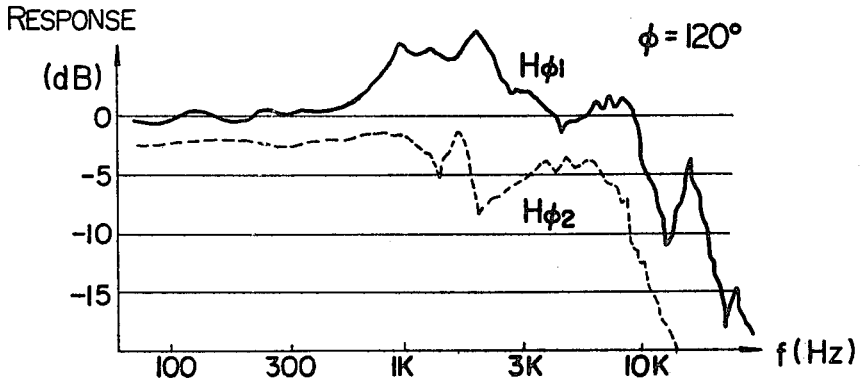
FIG. 4 shows an example of sound pressure frequency characteristics for left and right ears of a listener in a real sound field.

FIG. 3 shows a listening condition in which the sound source 5 is located at an angle of $\phi$ to the front of the listener 3. Under the listening condition shown in FIG. 3, characteristics as shown in FIG. 4 are obtained, where $H_{\phi 1}$ is a transfer function from the sound source 5 to the right ear of the listener 3 (Fourier transform of an impulse response between the sound source and the listener) and $H_{\phi 2}$ is a transfer function to the left ear. FIG. 4 shows an example of sound pressure frequency characteristics for the sound waves arriving to the left and right ears of the listener when the angle $\phi$ is equal to 120°. It is seen that different sound waves are received by the left and right ears of the listener 3.

Figure 5:
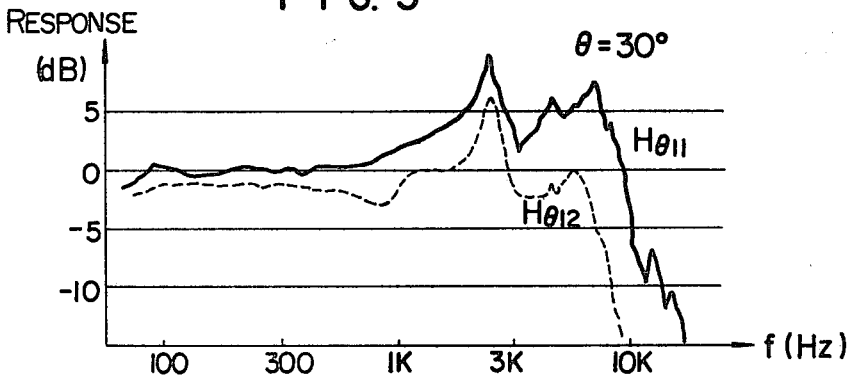
FIG. 5 shows sound pressure frequency characteristics for left and right ears of a listener for a two-speaker stereophonic sound reproducing system.
Figure 6:
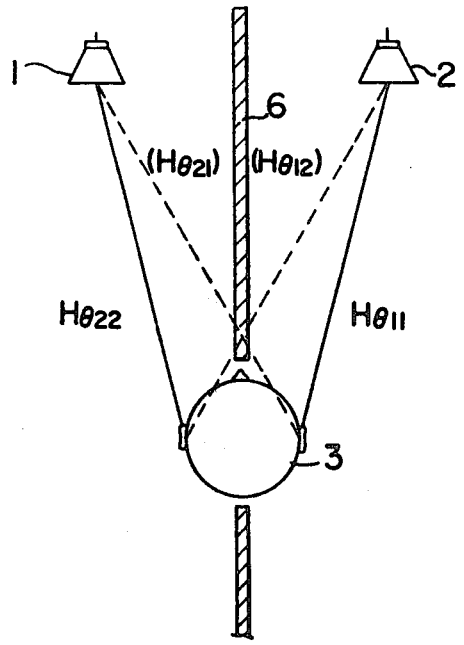
FIG. 6 shows a schematic diagram of a two-speaker stereophonic sound reproducing system having a sound absorbing wall.

On the other hand, in the two-speaker stereophonic sound reproducing system shown in FIG. 1, characteristics as shown in FIG. 5 are obtained, in which $H_{\theta 11}$ and $H_{\theta 12}$ are transfer functions from the loudspeaker 2 to the right and left ears of the listener 3, respectively, and $H_{\theta 21}$ and $H_{\theta 22}$ are transfer functions from the loudspeaker 1 to the right and left ears of the listener 3, respectively. In FIG. 5, the angle $\theta$ is equal to 30°.

When the listener receives the same sound wave in the 2-speaker reproducing sound field as the sound wave he receives when he listens to a real sound source shown in FIG. 3, the listener 3 recognizes the sound image 4' in the same direction as the real sound source 5 in FIG. 3.

When the listener 3 listens to the sound while sound absorbing walls 6 are arranged in front of and behind the listener 3, the transfer functions $H_{\theta 12}$ and $H_{\theta 21}$ which result in mutual crosstalk are absent. The transfer functions $H_{\theta 11}$ and $H_{\theta 22}$ which cause the listener 3 to recognize that the loudspeakers 1 and 2 are located in front of him can be cancelled by imposing their inverse transfer functions. Further, the transfer functions $H_{\phi 1}$ and $H_{\phi 2}$ which cause the listener to recognize that the sound wave arrives at the angle of $\phi$ can be created by imposing the characteristics thereof to loudspeaker input signals during the reproduction. In this manner, the range of the sound image can be spread relatively easily when the sound absorbing walls 6 are arranged.

Figure 7:
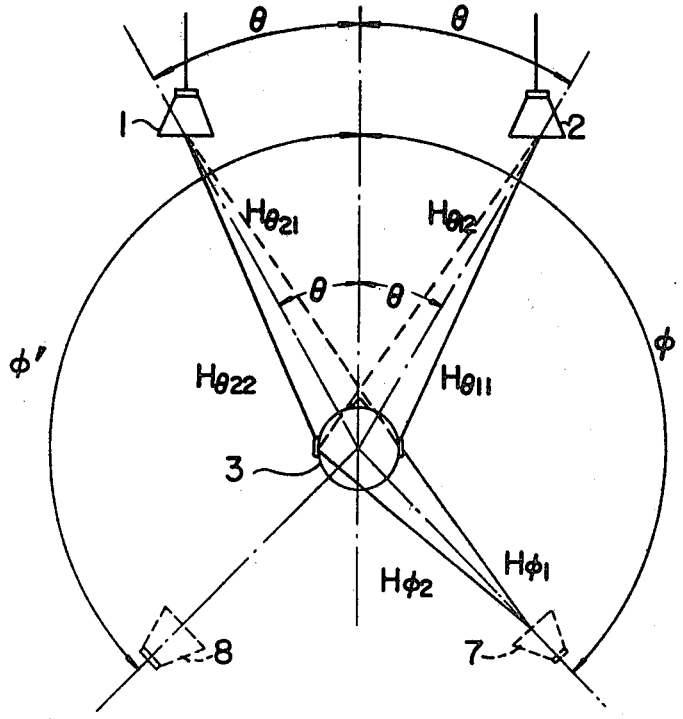
FIG. 7 shows a schematic diagram illustrating a listening condition in accordance with the present invention.

FIG. 7 shows a basic principle for attaining the spread of the range of the sound image without using the absorbing wall. In FIG. 7, numeral 3 denotes the listener, numerals 1 and 2 denote the loudspeakers located in front of the listener 3, and numerals 7 and 8 denote image loudspeakers which the listener 3 may recognize by a combined signal. In FIG. 7, the transfer functions from the loudspeakers 1 and 2 to the listener 3, e.g. formulas for reproducing the image loudspeaker 7 located at the angle of $\phi$, are expressed as follows.

Assuming that the loudspeakers 1 and 2 in FIG. 7 are identical and located symmetrically to the listener 3 in front of him, the following relations are obtained:

$$\left.\begin{aligned} H_{\theta 11} &= H_{\theta 22} \\ H_{\theta 12} &= H_{\theta 21} \end{aligned}\right\} \tag{1}$$

Thus, they can be represented as;

$$H_{\theta 11}=H_{\theta 22}=H_{\theta 1} \tag{2}$$

$$H_{\theta 21}=H_{\theta 12}=H_{\theta 2} \tag{3}$$

Now, considering a mechanism which enables the listener 3 to recognize the direction of the real sound source, since he can determine the direction of the sound source relatively independently of the distance to the sound source and he can determine also independently of the distance whether the sound source is located in front of him or behind him, one can assume that the determination of direction is mainly based on $H_{\phi 2}/H_{\phi 1}$ and the determination of front or back is mainly based on $|H_{\phi 1}|$.

Assuming that the sound source is located at the position of the image loudspeaker 7 and a sound input signal to the loudspeaker at that position is $A_s$, sound pressures $P_L$ and $P_R$ at the left and right ears of the listener 3 are expressed using $H_{\phi 1}$ and $H_{\phi 2}$ as follows:

$$\left.\begin{aligned} P_L &= H_{\phi 2} * A_s \\ P_R &= H_{\phi 1} * A_s \end{aligned}\right\} \tag{4}$$

where * represents a multiplication symbol. A ratio of the sound pressures at the left and right ears is expressed by;

$$\frac{P_R}{P_L} = \frac{H_{\phi 2} * A_s}{H_{\phi 1} * A_s} \tag{5}$$

Accordingly, $$P_L/P_R=H_{\phi 2}/H_{\phi 1} \quad . \tag{6}$$

Assuming that sound pressures at the left and right ears of the listener 3 created by the loudspeakers 1 and 2 are $P_L'$ and $P_R'$, respectively, and input voltages to the loudspeakers 1 and 2 are $E_L$ and $E_R$, respectively, a ratio of the sound pressures at the left and right ears of the listener 3 is given by;

$$\frac{P_{L'}}{P_{R'}} = \frac{H_{\theta 1} * E_L + H_{\theta 2} * E_R}{H_{\theta 1} * E_R + H_{\theta 2} * E_L} \tag{7}$$

From the equation (7), $$\frac{P_{L'}}{P_{R'}} = \frac{H_{\theta 1} * E_R\{1 + \frac{H_{\theta 2}}{H_{\theta 1}} * \frac{E_L}{E_R}\}}{H_{\theta 2} * E_R\{1 + \frac{H_{\theta 1}}{H_{\theta 2}} * \frac{E_L}{E_R}\}}$$

$$\frac{P_{R'}}{P_{L'}} = \frac{H_{\theta 1}}{H_{\theta 2}} * \frac{1 + \frac{E_R}{E_L} * \frac{H_{\theta 2}}{H_{\theta 1}}}{1 + \frac{E_R}{E_L} * \frac{H_{\theta 1}}{H_{\theta 2}}} \tag{8}$$

From the equations (6) and (8), the condition of $E_R/E_L$ which satisfies the relation of $$P_{L'}/P_{R'}=P_L/P_R$$

is expressed by;

$$\frac{E_L}{E_R} = \frac{H_{\theta 1} * H_{\phi 1} - H_{\theta 2} * H_{\phi 2}}{H_{\theta 1} * H_{\phi 2} - H_{\theta 2} * H_{\phi 1}} \tag{9}$$

By putting the equation (9) to the equation (8), $$\frac{P_{L'}}{P_{R'}} = \frac{H_{\theta 1}}{H_{\theta 2}} * \frac{1 + \frac{H_{\theta 1} * H_{\phi 2} - H_{\theta 2} * H_{\phi 1}}{H_{\theta 1} * H_{\phi 1} - H_{\theta 1} * H_{\phi 2}} * \frac{H_{\theta 2}}{H_{\theta 1}}}{1 + \frac{H_{\theta 1} * H_{\phi 2} - H_{\theta 2} * H_{\phi 1}}{H_{\theta 1} * H_{\phi 1} - H_{\theta 2} * H_{\phi 2}} * \frac{H_{\theta 1}}{H_{\theta 2}}} = \frac{H_{\phi 1}}{H_{\phi 2}} = \frac{P_R}{P_L} \tag{10}$$

Accordingly, it is possible to cause the listener to recognize the sound image in any direction $\phi$.

In this manner, it is possible to localize the sound image to the direction $\phi$ by the ratio of sound pressures $P_L/P_R$. However, when more precise localization of the sound image is desired, a front and back recognizing network may be added which is common with both ears and comprises a component $(1/H_{\theta 1})$ for cancelling information indicative of the presence of the loudspeakers 1 and 2 in front of the listener 3 and a further component $(H_{\theta 1})$ for localizing the sound image in any desired direction. The transfer function of this front and back recognizing network is expressed by the following formula.

$$(H_{\phi 1}/H_{\theta 1}) \tag{11}$$

Namely, assuming that an electrical input signal to the image loudspeaker 7 located at the angle $\phi$ in FIG. 7 is $A_s$, the sound pressure at the right ear of the listener 3 is expressed by;

$$P_R=H_{\phi 1} * A_s \tag{12}$$

On the other hand, the sound pressure at the right ear of the listener in the two-speaker stereophonic sound reproducing system shown in FIG. 7 is expressed by;

$$P_{R'}=(H_{\theta 1} * E_R+H_{\theta 2} * E_L)*A_s \tag{13}$$

The condition which satisfies the relation that the equations (12) and (13) are equal is given by;

$$E_R = \frac{H_{\phi 1}}{H_{\theta 1}} * \frac{1}{1 + \frac{H_{\theta 2}}{H_{\theta 1}} * \frac{E_L}{E_R}} \tag{14}$$

$$= \frac{H_{\theta 2}}{H_{\theta 1}} * \frac{1}{1 + \frac{H_{\theta 2}}{H_{\theta 1}} * \frac{H_{\phi 2}}{H_{\phi 1}} * \frac{(1 - \frac{H_{\theta 2}}{H_{\theta 1}} * \frac{H_{\phi 1}}{H_{\phi 2}})}{(1 - \frac{H_{\theta 2}}{H_{\theta 1}} * \frac{H_{\phi 2}}{H_{\phi 1}})}}$$

$$= \left\{ 1 + \sum_{n=1}^{\infty} \left(\frac{H_{\theta 2}}{H_{\theta 1}}\right)^{2n} \right\} * \left\{ 1 - \frac{H_{\theta 2}}{H_{\theta 1}} * \frac{H_{\phi 2}}{H_{\phi 1}} \right\} * \frac{H_{\phi 1}}{H_{\theta 1}}$$

Figure 8:
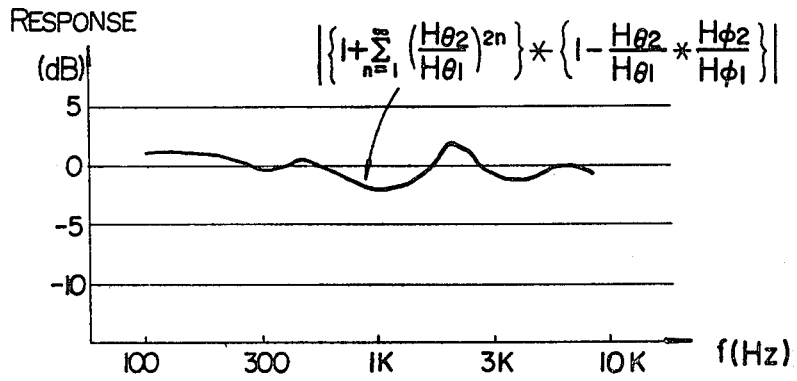
FIGS. 8 and 9 show examples of sound pressure frequency characteristics of a basic block of the sound reproducing system of the present invention.

Assuming that the reproducing loudspeakers are located at the angle of ±30° and the image loudspeaker is located at the angle of 120°, the frequency characteristic of the first to second terms in the equation (14), that is, $$\left\{ 1 + \sum_{n=1}^{\infty} \left(\frac{H_{\theta 2}}{H_{\theta 1}}\right)^{2n} \right\} * \left\{ 1 - \frac{H_{\theta 2}}{H_{\theta 1}} * \frac{H_{\phi 2}}{H_{\phi 1}} \right\} \tag{15}$$

is represented as shown in FIG. 8. Thus, the equation (15) can be regarded to be approximately equal to 1 and hence the equation (14) can be expressed as follows:

$$E_R \approx H_{\theta 1}/H_{\theta 1} \tag{16}$$

Figure 9:
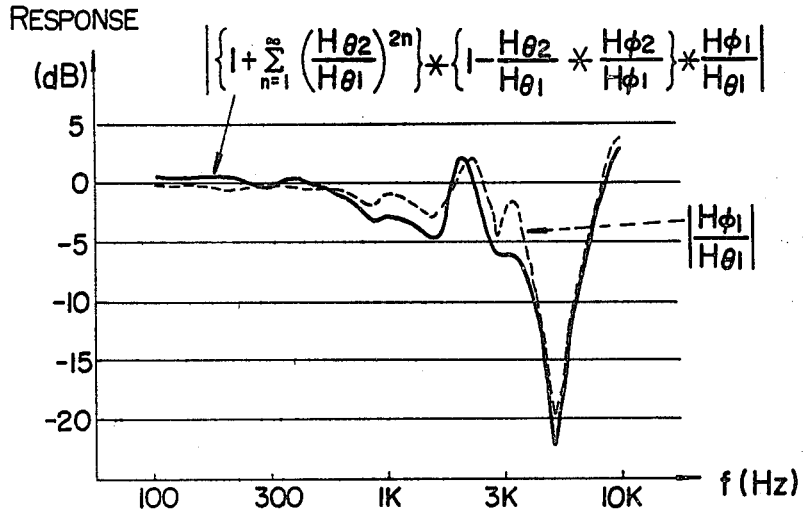

FIG. 9 shows a comparison of the frequency characteristics of the equations (14) and (16).

Figure 10:
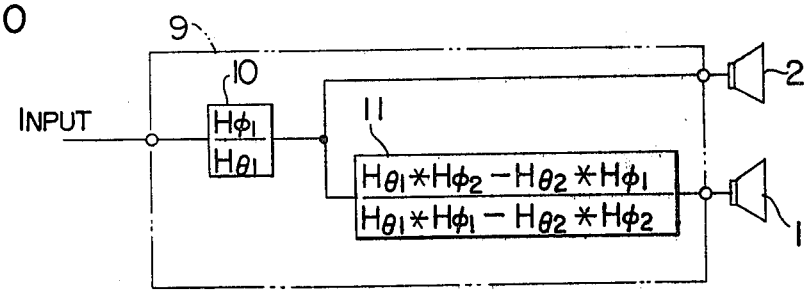
FIG. 10 shows a basic configuration of the present invention.

FIG. 10 shows a block diagram of a circuit configuration according to the present invention. It shows a block diagram of a sound reproducing system which enables the listener to recognize the sound image in the direction of the angle $\phi$ by the sound wave reproduced by a single-channel loudspeakers, that is, two speakers located in front of the listener (with the speakers being arranged at the angle $\theta$). In FIG. 10, numeral 9 denotes an entire circuit block, numeral 10 denotes a term which is common to the left and right ears, that is a term which mainly contribute to the determination of front and back, and numeral 11 denotes a difference creating term, that is a term which imposes different sound pressure frequency characteristic to the left and right ears.

Figure 11:
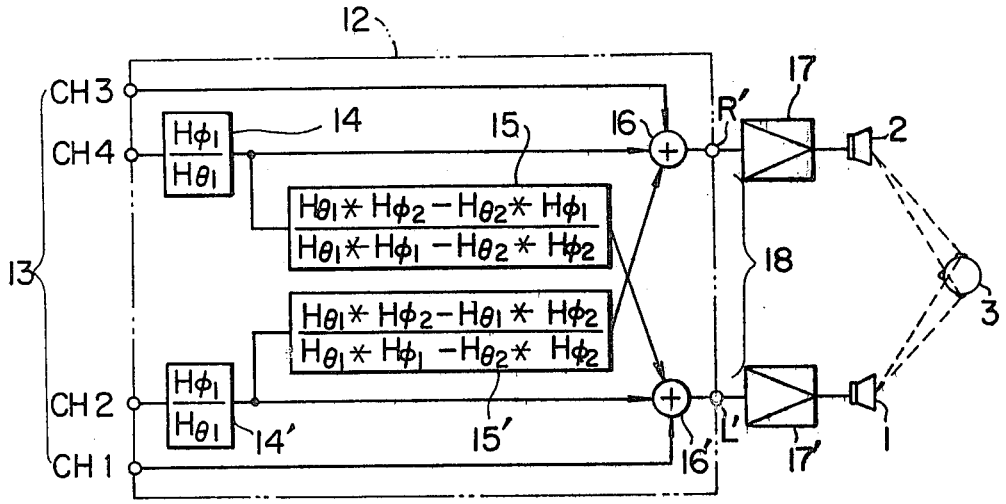
FIG. 11 shows a block diagram of one embodiment of the present invention.

FIG. 11 shows a specific circuit configuration in accordance with the present invention, which is designed to adapt to four-channel input. In the four-channel system, since the channels 2 and 4 are located behind the listener, the image loudspeakers 7 and 8 shown in FIG. 7 may be used as the back channel loudspeakers. In FIG. 11, numeral 12 denotes an entire block of signal processing for the four-channel input, numeral 13 denotes four-channel input terminals, numerals 14 and 14' denote common terms, numeral 15 and 15' denote differential terms for left and right ears, numerals 16 and 16' denote adders, numeral 17 and 17' denote amplifiers, numerals 1 and 2 denote the loudspeakers, numeral 3 denotes the listener and numeral 18 denotes output terminals of the signal processing block 12. Front channel signals are applied to the input terminals CH1 and CH3 and fed to the output terminals 18 without being processed. Back channel signals are applied to the input terminals CH2 and CH4 and processed by the common terms 14 and 14' to add the natures or characteristics as the back channel signals, and the information for causing the listener to feel that the sound is radiated from the front loudspeaker is cancelled. One of the back channel signals is directly mixed with one of the front channel signals while the other back channel signal is mixed with the other front channel signal after information indicative of the signal in the direction of 120° has been added to the other back channel signal. Those signals are then applied to the loudspeakers 1 and 2, which radiate sound waves, which are then received by the listener 3.

In this case, the listener 3 can localize two independent sound images at the angles of $\phi$ and $\phi'$. (In many cases, the angle $\phi$ is approximately equal to 120°.)

Figure 12:
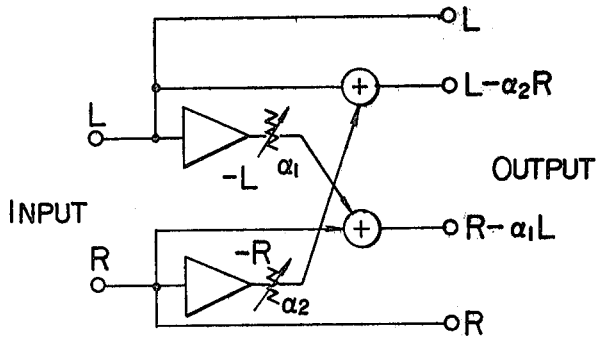
FIG. 12 is a block diagram of an indirect sound creating circuit used in another embodiment of the present invention.

In case of absence of independent four-channel signals, signals similar to the four-channel signals can be created from a conventional stereophonic program source. An example thereof is shown in FIG. 12. Differential signal component (L-R or R-L) is produced from a conventional stereophonic signal and the resulting signal may be used as the back channel component of the four-channel input signal block as shown in FIG. 12. In this connection, in the conventional program source, since the differential signal includes much components which mainly comprise reflected sounds and have no distinction between left and right phase relations, the presentation of the differential signal is enhanced compared to the conventional stereophonic sound reproduction.

Figure 13:
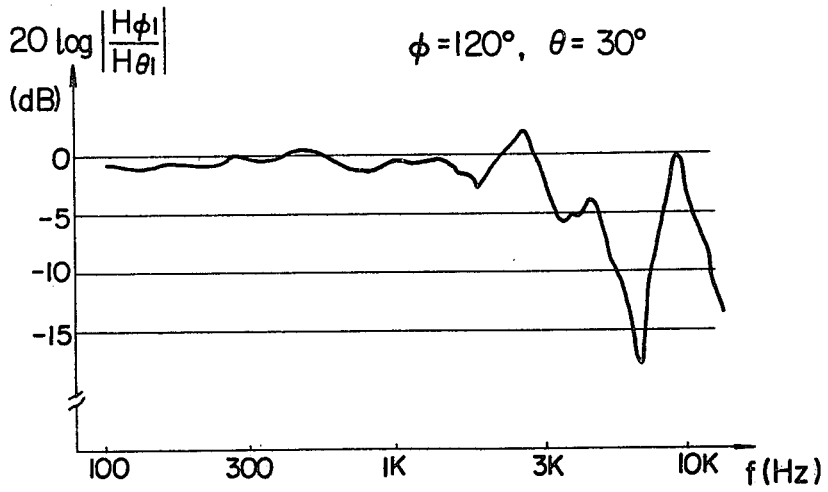
FIGS. 13 and 14 show sound pressure frequency characteristics of the respective blocks shown in FIG. 10.
Figure 14:
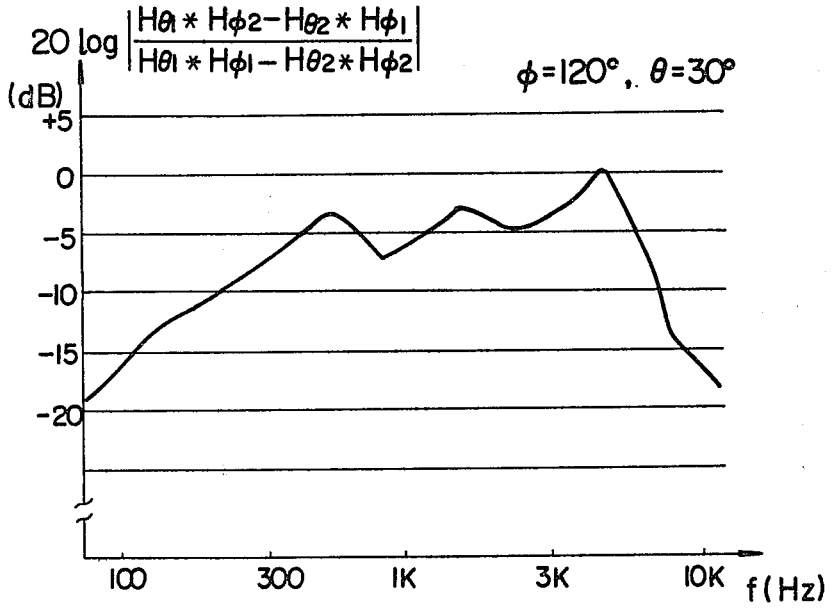

A specific example of characteristic of the common term 10 used in the block diagram of FIG. 10 is shown in FIG. 13, and a specific example of characteristic of the differential term 11 is shown in FIG. 14.

Figure 15:
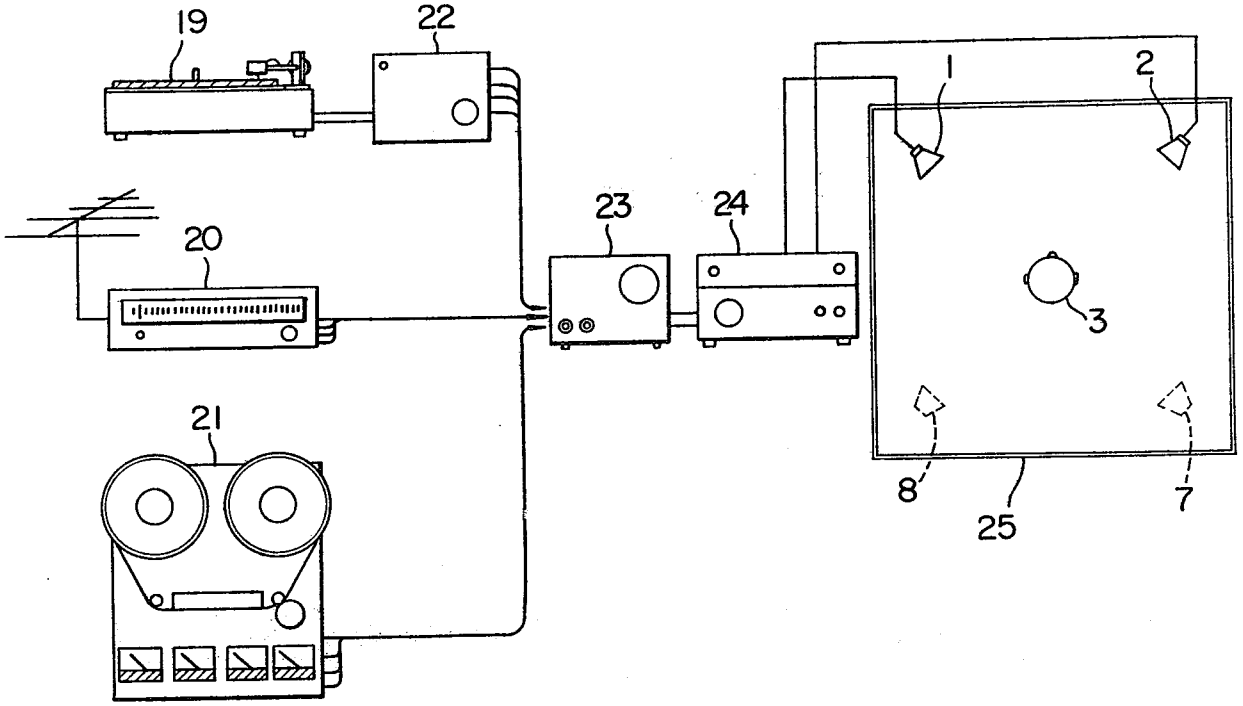
FIG. 15 shows a combination of the sound reproducing system of the present invention and various program sources.

FIG. 15 illustrates an example of connection of acoustic equipments which embodies the present invention. In FIG. 15, numeral 19 denotes a four-channel or two-channel disk record player, numeral 20 denotes a four-channel FM radio receiver, numeral 21 denotes a four-channel tape recorder, numeral 22 denotes a demodulator for the four-channel disk record, numeral 23 denotes a signal processing unit in accordance with the present invention, numeral 24 denotes a stereophonic amplifier, numerals 1 and 2 denote front loudspeakers, numerals 7 and 8 denote image loudspeakers which the listener 3 may recognize and numeral 25 denotes a listening room. According to the present invention, various equipments may be used in combination.

As described hereinabove, according to the present invention, the sound image can be localized in any desired direction around the listener while the sound is reproduced by two loudspeakers, and hence the four-channel stereophonic effect attained by the prior art four-speaker system is attained by the two-speaker system.

What is claimed is:

1. A sound reproducing means for reproducing sounds from two loudspeakers located in front of a listener in a manner in which said listener perceives a sound source being localized at any point around him comprising:

input means for receiving an input sound signal;

first transfer function means connected to receive said input sound signal and apply thereto a first transfer function which is common to both ears of the listener and which is the inverse of the acoustic transfer function which characterizes the acoustic path between one of said loudspeakers and one of the ears of said listener to cancel sound signal information from said input sound signal which causes the listener to perceive that said loudspeakers are located in front of him, said first transfer function means also applying to said input signal a second transfer function which characterizes the acoustic path between a location of an image sound source to be localized and one of the ears of said listener;

second transfer function means connected to the output of said first transfer function means for applying to the output signal of said first transfer function means a third transfer function proportional to said first and second transfer functions and to fourth and fifth transfer functions, said fourth transfer function being common to both ears of said listener and characterizing the acoustic path between said one loudspeaker and the other of the ears of said listener, said fifth transfer function characterizing the acoustic path between said other of the ears of said listener and the desired location of said image sound source, said second transfer function means causing the ratio of sound pressures applied to the left and right ears of said listener and with a time difference of arrival thereat of sounds radiated by said loudspeakers to respectively correspond to the ratio of sound pressures to the left and right ears and with a time difference of arrival thereat of sounds radiated by said image sound source at said location; and, means for respectively applying the output signals from said first and second transfer function means to said loudspeakers.

2. A sound reproducing system according to claim 1 wherein said second transfer function means has a signal transfer characteristic of $$\frac{H_{\theta 1} * H_{\phi 2} - H_{\theta 2} * H_{\phi 1}}{H_{\theta 1} * H_{\phi 1} - H_{\theta 2} * H_{\phi 2}}$$

where $H_{\phi 1}$ and $H_{\theta 2}$ are acoustic transfer functions from said image sound source to the left and right ears of the listener, respectively, and $H_{\theta 1}$ and $H_{\theta 2}$ are acoustic transfer functions from said two loudspeakers to the left and right ears of the listener, respectively, and said first transfer function means has a characteristic of $H_{\phi 1}/H_{\theta 1}$.

3. A sound reproducing system according to claim 2 wherein said input signal is divided into two portions after it has passed through said first transfer function means having the characteristic of $H_{\phi 1}/H_{\theta 1}$ and one of the signal portions is applied to the output means for one of said two loudspeakers while the other signal portion is applied to the output means for the other loudspeaker via said second transfer function means.

4. A sound reproducing system for reproducing sounds from a first and second loudspeaker located in front of a listener comprising:

a pair of output means for respective connection with said first and second loudspeakers;

means for forming differential signals $(L - \alpha_1 R)$ and $(R - \alpha_2 L)$ from two-channel stereophonic signals L and R, where $\alpha_1$ and $\alpha_2$ are constants, a first and second front and back recognizing network, each receiving a respective differential signal and having a signal transfer characteristic $H_{\phi 1}/H_{\theta 1}$ where $H_{\phi 1}$ represents a sound transfer function of a sound source image to an ear of a listener and $H_{\theta 1}$ represents a sound transfer function of a sound emitted by one of said loudspeakers to an ear of a listener, means for respectively applying the output signals from said first and second front and back recognizing network to the output means for said first and second loudspeakers;

a first ratio forming network receiving the output from said first front and back recognizing network and forming a ratio signal applied to the output means for said second loudspeaker, a second ratio forming network receiving the output from said second front and back recognizing means and forming a ratio signal applied to the output means for said first loudspeaker, each said ratio forming network having a signal transfer function which causes a ratio of sound pressures applied to the left and right ears of a listener and with a time difference thereat by the sounds radiated from said first and second loudspeakers to correspond to a ratio of sound pressures applied to the left and right ears of a listener and with a time difference of sound waves thereat by a sound image radiated from a source located at any desired point around the listener.

5. A sound reproducing system according to claim 4 further comprising means for applying said two-channel stereophonic signals L and R respectively to the output means for said first and second loudspeakers.

6. A sound reproducing system for applying sound signals to a pair of loudspeakers comprising:

input means receiving an input sound signal to be applied to said loudspeakers;

a first and second output means respectively connectable with said loudspeakers;

first means connected between said input means and said first output means for cancelling sound signal information from said input sound signals which would cause a listener to perceive said loudspeakers being located in front of him and for modifying said input signals in accordance with a front to back signal localization transfer function to permit front to back localization of a sound image; and, second means connected between the output of said first means and said second output means for modifying the output of said first means such that the signals at said first and second output means when radiated by said loudspeakers causes a ratio of sound pressures applied to the left and right ears of a listener with a time difference of sound signals thereat to correspond to a ratio of sound pressures applied to the left and right ears of the listener with a time difference of sound signals thereat which would be caused by a sound source located at any point around the listener.

* * * * *